US010329787B2

(12) United States Patent
Laffy

(10) Patent No.: US 10,329,787 B2
(45) Date of Patent: Jun. 25, 2019

(54) ANCHOR DEVICE

(71) Applicant: Kurt Franklyn Laffy, Jacksonville, FL (US)

(72) Inventor: Kurt Franklyn Laffy, Jacksonville, FL (US)

( * ) Notice: Subject to any disclaimer, the term of this patent is extended or adjusted under 35 U.S.C. 154(b) by 0 days.

(21) Appl. No.: 15/890,306

(22) Filed: Feb. 6, 2018

(65) Prior Publication Data

US 2018/0238073 A1 Aug. 23, 2018

Related U.S. Application Data

(60) Provisional application No. 62/455,650, filed on Feb. 7, 2017.

(51) Int. Cl.

| | |
|---|---|
| ***F16M 13/00*** | (2006.01) |
| ***E04H 12/22*** | (2006.01) |
| ***A45B 23/00*** | (2006.01) |
| ***A45F 3/44*** | (2006.01) |

(52) U.S. Cl.

CPC ..... *E04H 12/2215* (2013.01); *A45B 23/00* (2013.01); *A45F 3/44* (2013.01); *E04H 12/2253* (2013.01); *A45B 2023/0012* (2013.01)

(58) Field of Classification Search

CPC ..... A45B 11/00; A45B 2023/0012; E04H 12/2215

See application file for complete search history.

(56) References Cited

U.S. PATENT DOCUMENTS

| | | | | |
|---|---|---|---|---|
| 6,050,352 | A | 4/2000 | Thompson | |
| 6,354,554 | B1 | 3/2002 | Hollenbeck | |
| 6,516,897 | B2 | 2/2003 | Thompson | |
| 6,575,853 | B1 | 6/2003 | O'Neill | |
| 7,520,485 | B1 | 4/2009 | Giannetto | |
| 7,736,250 | B2 | 6/2010 | O'Neill et al. | |
| D630,834 | S | 1/2011 | Cohen | |
| 8,371,319 | B2 * | 2/2013 | Meibos | A45B 23/00 108/50.12 |
| D727,010 | S | 4/2015 | Greto | |
| 9,464,397 | B1 | 10/2016 | Abraham | |
| 9,629,427 | B1 | 4/2017 | Alm | |
| 9,706,820 | B1 | 7/2017 | Lopez | |
| 9,763,501 | B2 | 9/2017 | Supino | |

(Continued)

FOREIGN PATENT DOCUMENTS

WO 2005000066 A2 1/2005

*Primary Examiner* — Amy J. Sterling

(74) *Attorney, Agent, or Firm* — Charney IP Law LLC

(57) ABSTRACT

An anchor for supporting an elongate tubular object, the anchor including an elongate tubular member having a proximal end and a distal end; a nozzle at said proximal end, the nozzle having an opening remote from said elongate tubular member; and, a funnel at the distal end, the funnel tapering from a minimum diameter at the tubular member to a maximum diameter remote from the tubular member; wherein the funnel, the elongate member, and the nozzle are in liquid communication. The anchor may further include at least one fin extending outwardly from the tubular member, a fixation device for securing an elongate tubular object inserted through the funnel and into the tubular member, and/or a collar having an outside diameter greater than that of an outside diameter of the elongate tubular member.

20 Claims, 7 Drawing Sheets

(56) References Cited

U.S. PATENT DOCUMENTS

| | | | | |
|---|---|---|---|---|
| 9,890,551 | B1 * | 2/2018 | Delao | E04H 12/2215 |
| 9,968,167 | B2 * | 5/2018 | Volin | F16B 7/182 |
| 10,077,893 | B1 * | 9/2018 | Abraham | A45F 3/44 |
| 2003/0024460 | A1 | 2/2003 | Militello | |
| 2006/0016950 | A1 | 1/2006 | Bright et al. | |
| 2007/0096004 | A1 | 5/2007 | Quiambao, Jr. | |
| 2007/0256720 | A1 | 11/2007 | Deane | |
| 2008/0017226 | A1 * | 1/2008 | Nobert | E04H 12/2215 135/16 |
| 2009/0114795 | A1 | 5/2009 | Giannetto | |
| 2012/0042915 | A1 | 2/2012 | Dorr | |
| 2013/0037066 | A1 | 2/2013 | Dorr | |
| 2013/0051707 | A1 | 2/2013 | Pisano | |
| 2014/0230866 | A1 | 8/2014 | Paolucci | |
| 2015/0090307 | A1 | 4/2015 | Supino | |
| 2015/0320161 | A1 | 11/2015 | Perry | |

* cited by examiner

ANCHOR DEVICE

CROSS-REFERENCE TO RELATED APPLICATIONS

The present application claims the benefit of U.S. Provisional Application Ser. No. 62/455,650 filed Feb. 7, 2017, the disclosure of which is hereby incorporated by reference herein.

BACKGROUND OF THE INVENTION

The present invention relates to ground anchors for inserting and supporting elongate tubular members for temporary but secure vertical placement. The primary focus of these ground anchors is support poles for beach umbrellas. Notwithstanding, other objects that may be supported by the ground anchor include fishing rods, tiki torches, badminton nets, and volleyball nets, among others.

While many people enjoy beach outings, they wish to protect themselves from the sun's rays, wind, and blowing sand. They may also hope to delineate and identify a particular beach area, with an easily observed physical feature that will keep others at a distance while also providing a "locating beacon" that may be found easily during the day.

One manner of achieving these results is to install one or more beach umbrellas. Unfortunately, many people find installing a beach umbrella to be very difficult or impossible. Even if they can install the umbrella, many methods permit the umbrella to easily fall or be blown down by the wind. This represents a dangerous condition that has caused injury and even death.

Conventional methods of inserting a beach umbrella include inserting the umbrella pole into a shovel or bucket-dug hole and then backfilling the hole around the umbrella support. Other methods include the use of screw insertion devices that are specifically configured for this application with open tubular upper members within which an umbrella support may be placed. Neither of these methods has been found completely satisfactory.

BRIEF SUMMARY OF THE INVENTION

It would therefore be advantageous to provide an ANCHOR DEVICE which permits quick and easy installation of an elongate tubular member, such as a beach umbrella, while also providing superior security against unintended lifting or rotation of the umbrella.

In accordance with one embodiment of the present invention, referenced as Anchor A herein, an anchor for supporting an elongate tubular object comprises an elongate tubular member having a proximal end and a distal end; a nozzle at the proximal end, the nozzle having an opening remote from said elongate tubular member; and, a funnel at the distal end, the funnel tapering from a minimum diameter at the tubular member to a maximum diameter remote from the tubular member; wherein the funnel, the elongate member, and the nozzle are in liquid communication.

In Anchor A, the nozzle may be formed from a pair of tubular members connected by a tapering member. In this case, the first of the pair of tubular members may have an inside diameter of between 1 inch and 2 inches while the second of the pair of tubular members may have an inside diameter of between 0.4 inches and 1 inch.

In Anchor A, one of said pair of tubular members may have an inside diameter of between 0.4 inches and 1 inch.

In Anchor A, an exterior of the nozzle may be formed as a frustoconical cone.

Anchor A may further comprise at least one fin extending outwardly from the tubular member, the fin extending along a length of the tubular member. If so configured, the at least one fin may be retractable.

Anchor A may further comprise at least one fin extending outwardly from the tubular member, the fin extending along a length of the tubular member nearer the proximal end than the distal end thereof. If so configured, the fin may be tapered.

In Anchor A, the tubular member may include a threaded boss and the anchor may further comprise a screw adapted to translate within the threaded boss to secure an elongate tubular object inserted through the funnel and into the tubular member.

In Anchor A, the funnel may comprise a tapered floor and a continuous upstanding wall extending therefrom.

Anchor A may further comprise a collar, the collar having an outside diameter greater than that of an outside diameter of the elongate tubular member.

Anchor A may further comprise a collar, the collar having an outside diameter greater than that of an outside diameter of the elongate tubular member. When so configured, the collar may be located between the nozzle and the elongate tubular member.

Anchor A may further comprise a valve adapted to selectively halt or permit the flow of liquid through the device.

Anchor A may further comprise at least one fin extending outwardly from the tubular member, the fin extending along a length of the tubular member; a fixation device for securing an elongate tubular object inserted through the funnel and into the tubular member; and, a collar having an outside diameter greater than that of an outside diameter of the elongate tubular member.

In accordance with a further embodiment of the present invention, Kit A may be configured from Anchor A and a storage container, the storage container comprising a first member and a second member adapted to connect thereto to form an interior void, wherein the anchor may be placed within the interior void.

In Kit A, at least one of the first member and the second member may include a handle.

In Kit A, the first and second members may be tubular and include matching threads for screwing the members together.

In accordance with an additional embodiment of the present invention, Method A of installing a beach umbrella into sand may comprise positioning an elongate anchor device in a generally vertical orientation relative to the earth, the anchor device including a funnel and a nozzle; pouring liquid into the funnel such that the liquid exits the nozzle, creating voids in the earth as the liquid exits the nozzle; permitting the anchor device to drop into the void; and, inserting a beach umbrella pole of the beach umbrella into the anchor device.

Method A may further comprise pouring additional liquid into the funnel; and permitting the anchor device to drop into the voids until a marking on the anchor device is at least level with the earth.

Method A may further comprise, after the step of permitting, slightly lifting the anchor device upon meeting of resistance followed by again permitting the anchor device to drop into the voids.

In Method A, the step of permitting may be conducted by a first individual and the step of pouring may be conducted by a second individual.

BRIEF DESCRIPTION OF THE DRAWING FIGURES

The subject matter regarded as the invention is particularly pointed out and distinctly claimed in the concluding portion of the specification. The invention, however, both as to organization and method of operation, together with features, objects, and advantages thereof, will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

DETAILED DESCRIPTION

Figure 1:
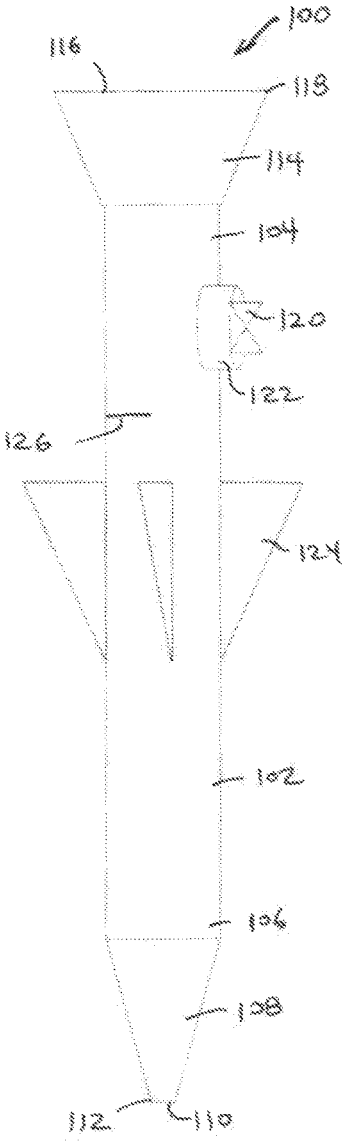
FIG. 1 depicts a frontal view of an anchor device in accordance with a first embodiment of the present invention.

In the following are described the preferred embodiments of the ANCHOR DEVICE of the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Where like elements have been depicted in multiple embodiments, identical reference numerals have been used in the multiple embodiments for ease of understanding.

For purposes of this disclosure, the term "attached" has been used in several places. "Attached" shall not be construed to be so limiting as to require two separate articles first formed and then brought together. Rather, two portions of a single device may be "attached" notwithstanding that they are formed together. For example, the funnels detailed below may be "attached" to the elongate tubular members detailed below by, for example, forming the two members separately and physically joining them or by forming them, or portions of them, simultaneously together.

Details of the invention may be appreciated by considering the entirety of the submission. However, in accordance with the present invention, and as shown in FIG. 1, a first embodiment of an anchor device 100 includes an elongate tube 102 having a proximal end 104 and a distal end 106.

Attached to the elongate tube 102 at its proximal end 104 is a nozzle, in this case having an exterior taking the form of a frustoconical cone 108. This attachment may be by screwing the two members together, gluing the two members together, by pressure fit, single injection or other mold, or by other means. The frustoconical cone 108 tapers from a maximum diameter at the proximal end 104 of the elongate tube 102 to its minimum diameter at an opening 110, which forms the extreme proximal end 112 of the anchor device 100. Preferably the maximum diameter of the frustoconical cone 108 matches the diameter of the elongate tube 102.

Attached to the distal end 106 of the elongate tube 102 is a funnel 114. This attachment may be by screwing the two members together, gluing the two members together, by pressure fit, or by other means. The funnel 114 tapers from its maximum diameter at its opening 116 at the extreme distal end 118 of the anchor device 100 to its minimum diameter at the distal end 106 of the elongate tube 102. Preferably the minimum diameter of the funnel 114 matches the diameter of the elongate tube 102.

It will be appreciated that the funnel 114, elongate tube 102, and frustoconical cone 108 are all hollow and in liquid communication such that water or other liquid poured into the funnel will travel through the elongate tube and finally the frustoconical cone where it will be expelled from the opening 110 under at least the force of the resulting pressure head.

While dimensions of the anchor device 100 may vary depending on its intended use, for use as an umbrella anchor the overall length of the anchor device, from the extreme distal end 118 to the extreme proximal end 112, is typically between 12 inches and 72 inches. A preferred length is between 19 inches and 36 inches.

The inside diameter of the elongate tube 102 is preferably between 1 inch and 2 inches, and the tube is preferably configured with a single, consistent, inside diameter. In other embodiments there may be internal features which lessen the inside diameter of the elongate tube 102 in periodic intervals or in predetermined locations. For example, the inside diameter of the tube may be 2 inches for the majority of its length, with periodic internal collars forming a diameter of 1 inch in those collared areas, or a single collar forming a diameter of 1 inch in a single collared area. Such a configuration could aid in stabilizing beach umbrella pole with a diameter which is too small to be stabilized in the larger diameter tube.

Moreover, the inside diameter of the tube may include features to aid in flow of liquid through the tube. These features may take the form of various channels or raised paths sufficient to create a vortex in the flowing liquid, vortexes generally being known to transfer fluid more efficiently than turbulent flow.

The opening 110 of frustoconical cone 108, at the extreme proximal end 112 of the anchor device 100, is preferably 0.4 inches to 1 inch in diameter. It has been found through testing that diameters less than 0.4 inches and greater than 1 inch provide less than optimal results for insertion of the frustoconical cone 108 (and anchor device 100) into sand, as will be discussed. Indeed, in preferred embodiments the entire cone 108 includes a single inside diameter of between 0.4 inches and 1 inch. Preferably, the length of the cone 108 is between 1 inch and 6 inches long, with 3 inches to 4 inches being preferred for ideal water jetting.

Optional features of the anchor device 100 include a fixation device for fixing an elongate tubular member, such as a beach umbrella pole, within said elongate tube 102. In preferred embodiments the fixation device comprises a fixation set screw 120 cooperating with a threaded boss 122 located through the elongate tube 102, preferably toward the distal end 106. It will be appreciated that once the beach umbrella pole (for the remainder of this disclosure the elongate tubular device to be inserted into the anchor devices will be referred to as a beach umbrella pole) is inserted into the elongate tube 102, the fixation set screw 120 may be turned to translate the screw along the threaded boss 122, positioning the tip of the screw (refer to FIG. 5) against the beach umbrella pole inserted within the elongate tube 102, thus holding the beach umbrella pole in place and preventing uplift.

Also optional are a series of fins 124 extending from the elongate tube 102, and preferably located below the midpoint and toward the proximal end 104. The fins 124 may be configured to many shapes, and here are shown as tapering as they extend toward the extreme proximal end 112 of the anchor device 100. It has been found that a generally triangular, or tapering, fin 124 provides a balance between insertion resistance and removal ease versus a more rectangular fin. The fins 124 are provided such that their surface areas help prevent rotation of the anchor device 100 following installation, such rotation requiring the difficult task of rotating adjacent sand.

Use of the anchor device 100 may be as follows. A user first identifies a suitable location for installation of the anchor device 100 into the earth. Preferably the location will be sand. Various beaches were tested, and it has been found that all sand, whether damp or dry, fine or coarse, was suitable for installation. One may also insert the device into suitable soils, particularly those which are particularly loose or sandy, rather than those which comprise greater amounts of organic materials or clay.

The user then positions the anchor device 100 in a generally vertical orientation with respect to the earth with the extreme proximal end 112 just hovering over the sandy beach. The user or an assistant fills the funnel 114 with water or other liquid via the opening 116. As the funnel 114 is filling sand beneath the nozzle, in this case the frustoconical cone 108, will begin to be displaced and a void will be created due to jetting action of the liquid as it is expelled from the nozzle. The user simply follows the displacement of sand by permitting the anchor device 100 to drop into the void. Little to no downward pressure on the anchor device 100 is required.

As discussed, the hydrostatic head of the liquid column within the elongate tube 102 will saturate and forcibly displace the sand located directly beneath and adjacent the opening 110, creating a void. As the anchor device 100 is permitted to drop deeper and deeper into the voids, the user may continue to add liquid as necessary to saturate and displace more and more sand. Using this water drilling technique, it has been found that no, or virtually no, downward force needs to be applied to the anchor device 100. Rather, application of liquid through the anchor device 100 creates a void directly beneath the opening 110, which is quickly filled with the device itself through user-permitted downward motion of the device.

In some earth types insertion may also be aided by permitting the device to drop into the void until resistance is met. Then, a user may back off bit, for example by lifting the device slightly, and then permit the device to again drop, all the while continuing to apply liquid.

Indeed, device prototypes are routinely installed in under 10 seconds with no application of downward pressure.

It is again noted that the opening 110 is preferred to have a diameter of between 0.4 inches and 1 inch. Through testing it has been found that diameters of less than 0.4 inches prevent adequate flow of liquid through the frustoconical cone 108 during installation while diameters of greater than 1 inch permit too much liquid through. Inadequate liquid will prevent sand from being displaced quickly enough while too much liquid will oversaturate the sand and not displace it enough.

To be sure, in the procedure described above, the hydrostatic pressure is relatively minimal, providing perhaps 1 to 5 psi of pressure in relatively short anchors and up to approximately 15 psi of pressure in longer models. Of course, the pressure diminishes as the liquid pressure head decreases.

In other embodiments, a plunger (not shown) may be provided to force the water column through the elongate tube 102 at a rapid pace. In this regard, the plunger may be sized to fit in a water-tight manner within the elongate tube whereby the plunger can force liquid out of the nozzle upon relative downward movement as compared to the elongate tube.

Figure 2:
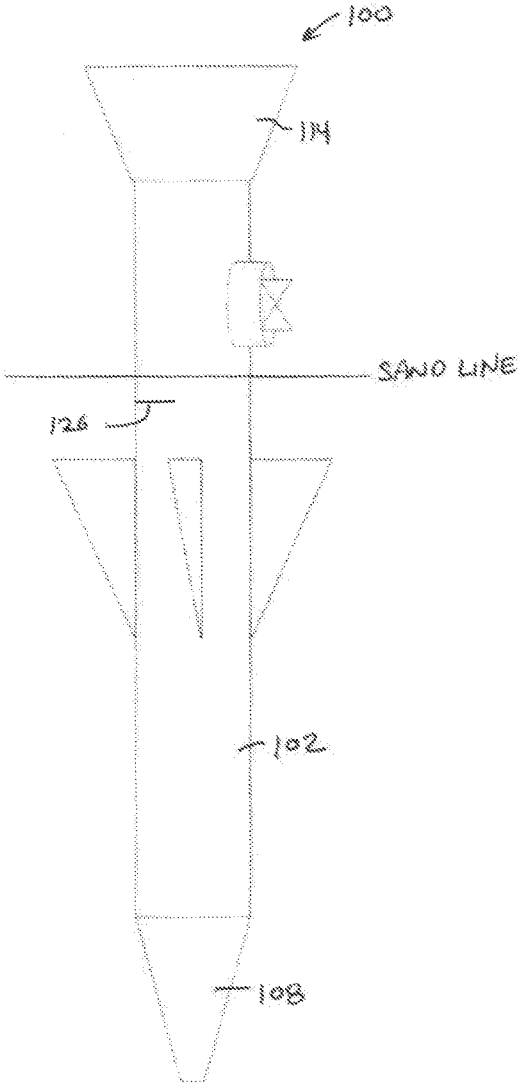
FIG. 2 depicts a frontal view of the anchor device shown in FIG. 1, as inserted into sand.

Additionally, the anchor device 100 may include markings 126 provided on the elongate tube 102 as an indication of the minimum insertion depth. That is, a user should insert the anchor device 100 until the sand surface is at least level with the marking 126 to safely embed the anchor against uplift and other forces. An anchor device 100 so inserted is shown in FIG. 2.

Once the anchor device 100 is so positioned, an umbrella pole may be placed in the opening 116 of the funnel 114 and permitted to drop through the elongate tube 102 until it rests upon some portion of the frustoconical cone 108. The fixation set screw 120 may then be inserted into the threaded boss 122 (preferably the threaded set screw 120 is prepositioned and already partially threaded) and advanced to set against the umbrella pole, holding it in place.

Figure 3:
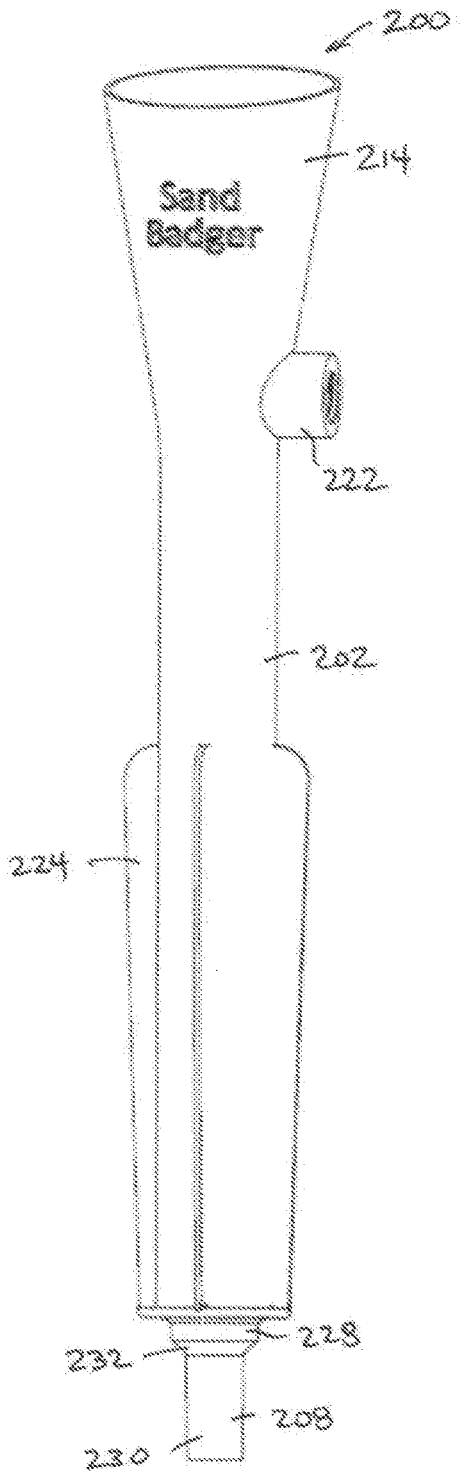
FIG. 3 depicts a frontal view of an anchor device in accordance with a second embodiment of the present invention, with a set screw component removed.

FIG. 3 depicts an anchor device 200 in accordance with a second embodiment of the present invention. The anchor device 200 includes many of the same features of the anchor device 100, and generally operates in the same manner. These features include the funnel 214, elongate tube 202, and nozzle 208. In this embodiment, however, the nozzle 208 is provided in tubular sections with a short transition between. Specifically, a first tubular section 228 abuts the elongate tube 202 at its proximal end 204. A second tubular section 230 is connected to the first tubular section 228 by a tapered section 232.

The inside diameter of the second tubular section 230 is preferably 0.4 inches to 1 inch, essentially matching the diameters provided by the opening 110 of the frustoconical cone 108 of anchor device 100. Preferably this inside diameter is consistent through the length of the second tubular section 230.

The inside diameter of the elongate tube 202 is preferably between 1 inch and 2 inches, and therefore so is the inside diameter of the first tubular section 228. The tapered section 232 therefore transitions the 1 inch to 2 inch inside diameter of the first tubular section 228 to the 0.4 inches to 1 inch diameter of the second tubular section 230. This taper can be abrupt, essentially abutting the two different diameters directly against each other, or may be more of a true gentle sloping taper.

In testing it has been proven that this "stepped" nozzle 208 provides a greater level of water jetting than the frustoconical cone 108 shown previously in a wide variety of sand types, and therefore typically performs better in practice.

While the anchor device 200 includes fins similar to those of anchor device 100, the fins 224 are elongated and provided with a much less extreme taper and resulting surface area. It has been found that these smaller fins 224 still adequately aid in preventing rotation of the anchor device 200 once installed.

Figure 4:
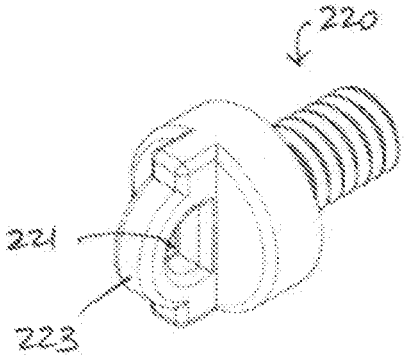
FIG. 4 depicts a frontal perspective view of the set screw component of the anchor device shown in FIG. 3.
Figure 5:
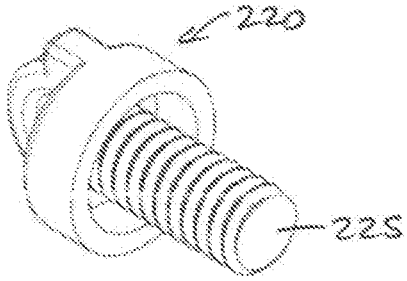
FIG. 5 depicts a rear perspective view of the set screw component of the anchor device shown in FIG. 3.

It is also noted that anchor device 200 includes a threaded boss 222. As indicated previously a fixation set screw may be screwed into the threaded boss 222 to affix a beach umbrella pole in place. Suitable fixation set screws 220 are shown in FIGS. 4 and 5. Following up on prior indication of a tip of a set screw, it is noted that tip 225 is shown in FIG. 5.

It will be appreciated that the fixation set screws 220 may include an aperture 221 in the externally exposed handle portion 223 which a user manipulates to turn the fixation set screw. This aperture 221 permits a user to attach a tether to the fixation set screw 220 to secure other items from being blown away, such as small beach tents or shelters. Another use includes tethering the fixation set screw 220 to the beach umbrella pole (not shown) to help prevent the umbrella from becoming separated from the anchor device 100, providing a second layer of protection beyond the force of the fixation set screw itself. Lastly, the aperture 221 may be used to tether the fixation set screw 220 to the anchor device 100 simply to prevent the fixation set screw from becoming lost during storage or transit, or for use as a tether for hanging during storage.

Figure 6:
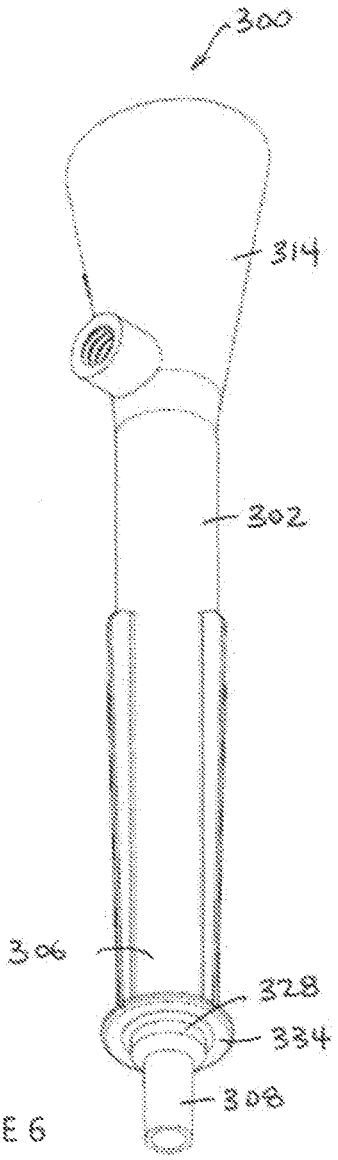
FIG. 6 depicts a bottom perspective view of an anchor device in accordance with a third embodiment of the present invention, with a set screw component removed.

FIG. 6 depicts an anchor device 300 in accordance with a third embodiment of the present invention. The anchor device 300 includes many of the same features of the anchor device 200, and generally operates in the same manner. These features include the funnel 314, elongate tube 302, and nozzle 308, provided in the form of tubular sections with a short transition between. Here, however, at the intersection of first tubular section 328 and the distal end 306 of elongate 302, the anchor device 300 includes a collar 334. The collar 334 has an outside diameter larger than that of the elongate tube 202, and helps to prevent uplift of the anchor device 300 following installation.

Figure 7:
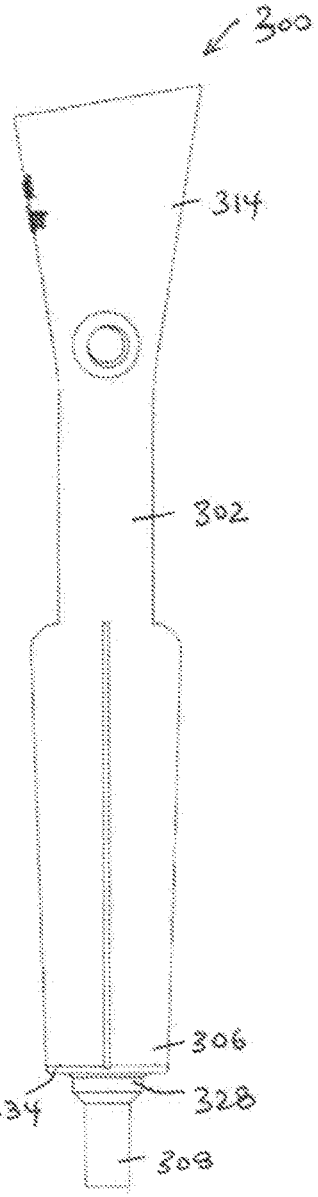
FIG. 7 depicts a side view of the anchor device shown in FIG. 6.
Figure 8:
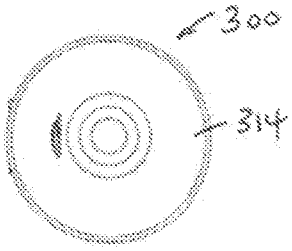
FIG. 8 depicts a top view of the anchor device shown in FIG. 6.
Figure 9:
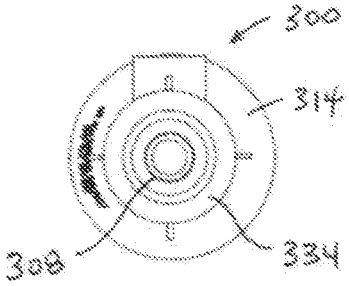
FIG. 9 depicts a bottom view of the anchor device shown in FIG. 6.

FIGS. 7-9 depict various other views of the anchor device 300 as described above.

Figure 10:
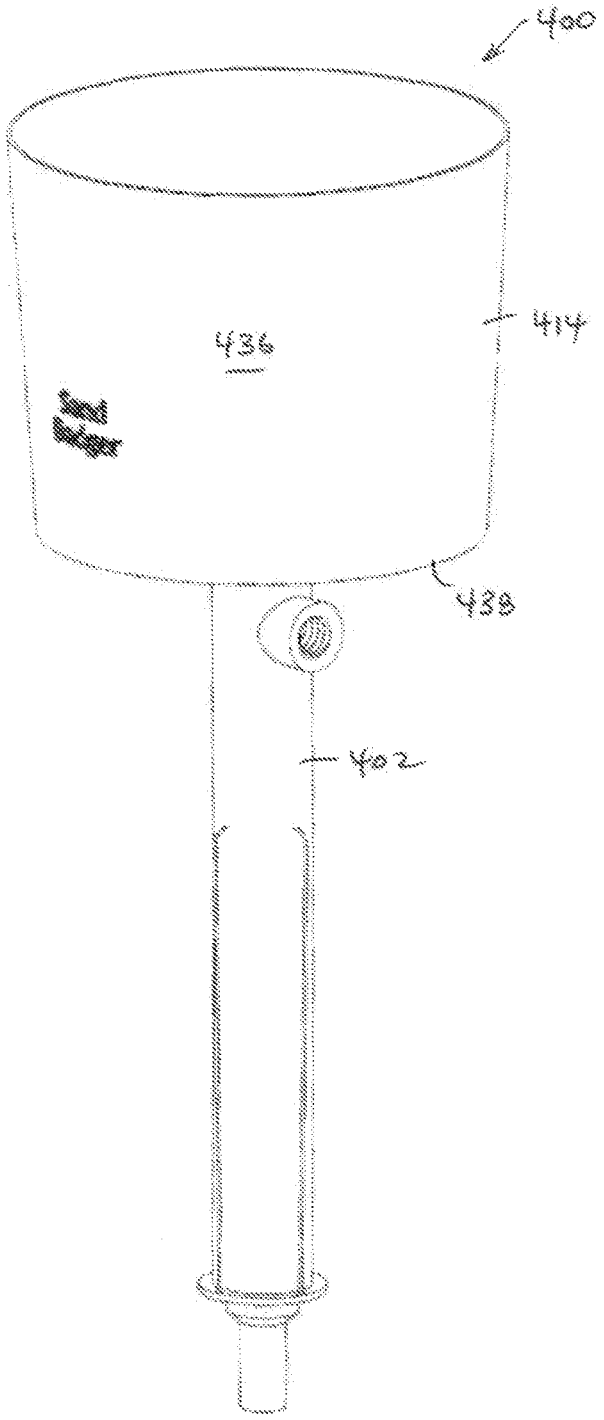
FIG. 10 depicts a side perspective view of an anchor device in accordance with a fourth embodiment of the present invention, with a set screw component removed.
Figure 11:
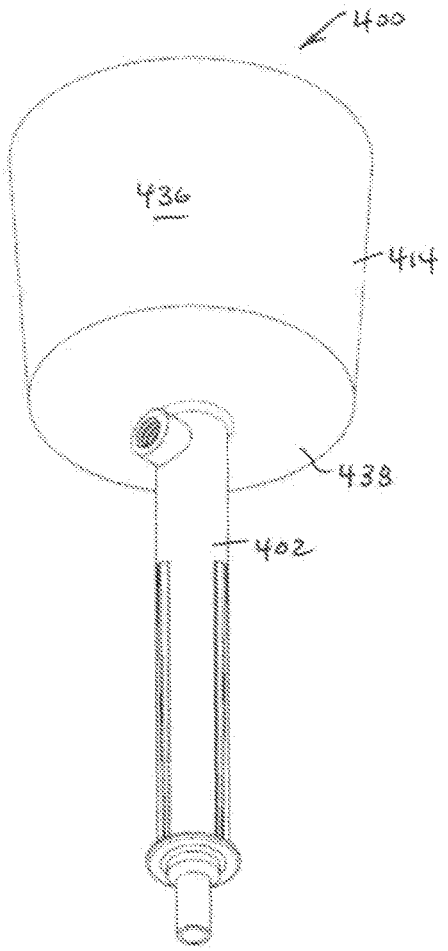
FIG. 11 depicts a bottom perspective view of the anchor device of FIG. 10.
Figure 12:
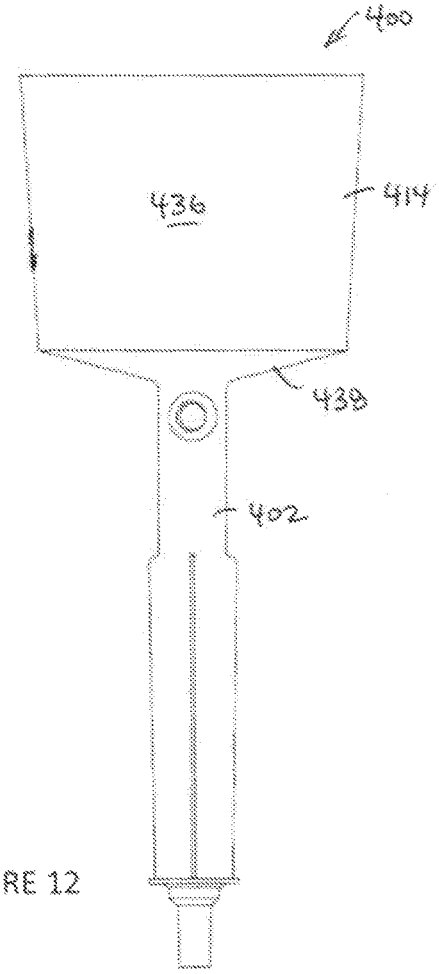
FIG. 12 depicts a side view of the anchor device shown in FIG. 10.
Figure 13:
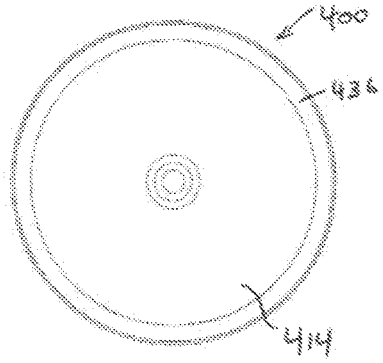
FIG. 13 depicts a top view of the anchor device shown in FIG. 10.
Figure 14:
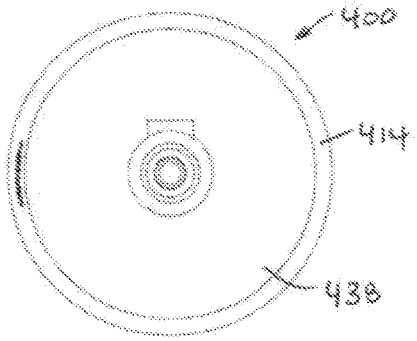
FIG. 14 depicts a bottom view of the anchor device shown in FIG. 10.

FIG. 10 depicts an anchor device 400 in accordance with a fourth embodiment of the present invention. Again, anchor device 400 includes many of the same features of anchor devices 300, and generally operates in the same manner. Here, however, the funnel 414 is provided in the form of a bucket funnel with a continuous wall 436 extending upward from a tapered floor 438 (best shown in FIG. 12).

The bucket 414 is designed with a much greater volume than the funnels 114, 214, and 314 previously discussed, and can therefore store a usable volume of liquid. While funnels 114, 214, and 314 are useful to aid in pouring, serving to catch liquid and ensure that liquid flows through the respective device rather than directly on the ground, the funnels are not generally intended to store liquid. It is contemplated that the bucket 414 have a capacity of approximately 1.5 gallons of liquid. This added capacity helps a user to maintain a supply of liquid to displace the ever-deepening layers of sand encountered as the anchor device 400 is inserted by naturally applying a longer continuous source of water flow than permitted with a funnel absent constant pouring of water through the funnel. In some instances this may aid in solo insertion of the device. It also enables a user to store liquid in the bucket 414 for transport from a water source (see below).

Although not shown, it will also be appreciated that the elongate tube 402 may include a device, such as a valve, that can momentarily halt the flow of liquid. In this regard, a user may fill the bucket 414 with liquid with the device restricting flow through the elongate tube 402. When the user is ready to insert the anchor device 400, the user can manipulate the device—for example by turning a valve actuator—to permit the flow of fluid. In other embodiments there may be button or other device which prevents the flow of fluid only while depressed.

One other use of the bucket 414, or funnels 114, 214, 314, for that matter, is as storage, even after a beach umbrella pole has been inserted. This storage can be used for cell phones, sun glasses, wallets, etc., and keeps these items out of the sand. Although not shown, the bucket 414 or funnels 114, 214, 314 may be provided with a lid, such as a plastic cap that can snap over the edges to secure stored contents.

In certain embodiments, the bucket 414 may also be removable from the remainder of the anchor device 400 such as by unscrewing it from elongate tube 402 or disconnecting a pressure fit. So separated, a user can fill the bucket 414 with water at a location remote from the remainder of the anchor device and then connect the two for further use. This is particular helpful on the beach where one may use ocean water. It will be appreciated that in this embodiment, it is preferred to include a valve or other flow restriction device as a component of the bucket 414.

FIGS. 11-14 depict various other views of the anchor device 400 as described above.

Figure 15:
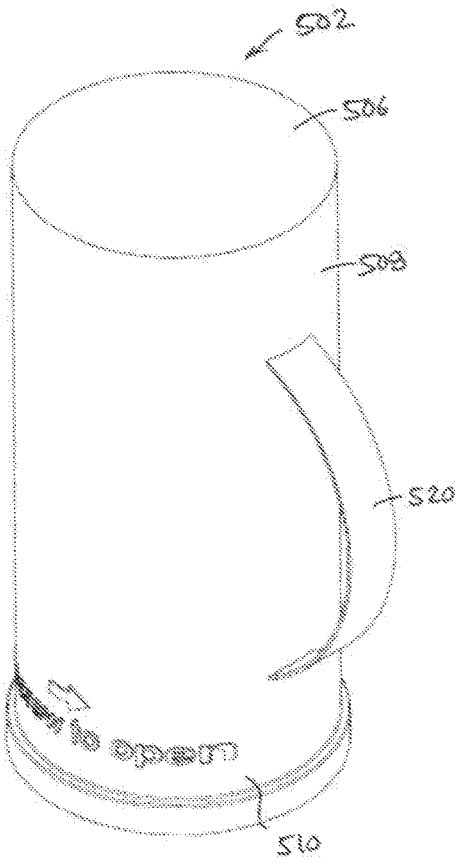
FIG. 15 depicts a perspective view of a top portion of a container which may be used with the anchor devices of the present invention; and, FIG. 16 depicts a perspective view of a bottom portion of the container referenced in relation to FIG. 15.
Figure 16:
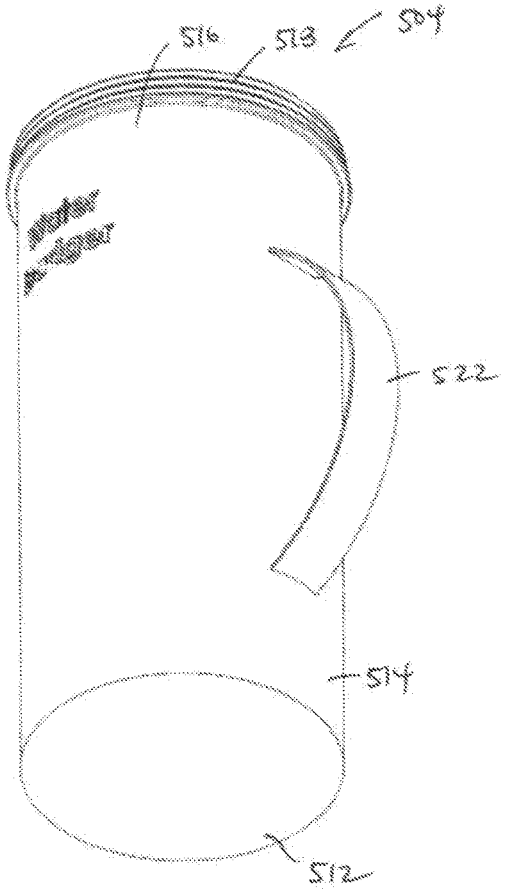

FIGS. 15-16 depict perspective views of a top portion 502 of a container and bottom portion 504 of a container that may be used with the anchor devices of the present invention. It will be appreciated that the top portion 502 of the container comprises a circular top 506 with a single downwardly depending wall 508. An inner surface of the distal end 510 of the wall 508, opposite the top 506, is threaded (not shown).

The bottom portion 504 of the container includes a circular floor 512 with a single upstanding wall 514 extending upwardly therefrom. An outer surface of the distal end 516, opposite the floor 512, is threaded with threads 518.

It will be appreciated that the threads 518 mate with the threads (not shown) of the top portion 502 of the container such that the two portions 502, 504 can be screwed together to form an enclosed void in the form of an enclosed case. Other manners of forming an enclosed case may also be provided.

One purpose of the container is to store and protect the anchor devices of the present invention. As such, the overall length and diameter of the container should accommodate the devices.

Another purpose of the container is to provide a means for collecting and pouring liquid into the anchor devices of the present invention. Either or both of the top portion 502 and bottom portion 504 may include handles 520, 522, respectively, to aid in holding the portions when filled with liquid as well as in pouring the liquid.

The effectiveness of anchor devices shown herein has been proven in testing. Indeed, a prototype was installed in under seconds, complete with a conventional beach umbrella both inserted and in an open position, and remained in place for over 5 hours with constant 20 plus mile per hour winds and gusts in excess of 25 miles per hour.

Although not shown, anchor devices, and preferably the elongate tubes thereof, may also be provided with taps to which a hose may be connected, preferably with a quick-connection mechanism. The hose can then be used to transfer liquid into the device. This is particularly suitable for locations where there is a water spigot available, or for locations with multiple installations, such as commercial beachfront facilities.

With respect to multiple installations, beyond use of a local spigot it is contemplated that an installer may carry a reservoir of liquid either on his/her back or on a pull cart or motorized device. Through the tap the liquid can be quickly transferred into the anchor device for quick installation, potentially also using higher pressures than just the pressure formed from the liquid column within the elongate tube. Of course, in such situations the user may alternatively pour liquid into the multiple funnels in the manner initially described.

In a further embodiment of the anchor device, the fins, such as fins 224, and/or the collar 334, may retract in and out of the anchor device. In this regard the retractable components may be positioned within the elongate tube of the anchor device during sand insertion and then pushed out of the device through force exerted by beach umbrella pole. It will be appreciated that in certain conditions this may aid in insertion of the device into sand by limiting friction along the sand-anchor interface.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A method of installing a beach umbrella into sand, said method comprising:

positioning an elongate anchor device in a generally vertical orientation relative to the earth, the anchor device including a funnel and a nozzle;

pouring liquid into the funnel such that the liquid exits the nozzle, creating voids in the earth as the liquid exits the nozzle;

permitting the anchor device to drop into the voids; and, inserting a beach umbrella pole of the beach umbrella into the funnel.

2. The method of claim 1, further comprising the steps of: pouring additional liquid into the funnel; and permitting the anchor device to drop into the voids until a marking on the anchor device is at least level with the earth.

3. The method of claim 1, further comprising, after the step of permitting, slightly lifting the anchor device upon meeting of resistance followed by again permitting the anchor device to drop into the voids.

4. The method of claim 1, wherein the step of permitting is conducted by a first individual and the step of pouring is conducted by a second individual.

5. The method of claim 1, further comprising turning a set screw to fix the beach umbrella in place.

6. The method of claim 5, further comprising tethering items to the set screw.

7. The method of claim 1, wherein the nozzle has an opening with a diameter of between 0.4 inches and 1 inch.

8. The method of claim 1, wherein the nozzle comprises a first tubular section and a second tubular section connected by a tapered section.

9. The method of claim 1, wherein the anchor device includes an elongate tube between the funnel and nozzle.

10. The method of claim 9, wherein the elongate tube has an inside diameter of between approximately 1 inch and 2 inches.

11. The method of claim 1, wherein the step of pouring includes pouring and forcing.

12. The method of installing a beach umbrella anchor into sand, said method comprising:

positioning an elongate anchor device in a generally vertical orientation relative to the earth, the anchor device including a first member and a nozzle;

pouring liquid into the first member such that the liquid exits the nozzle, creating voids in the earth as the liquid exits the nozzle;

permitting the anchor device to drop into the voids.

13. The method of claim 12, wherein the first member is a funnel.

14. The method of claim 13, further comprising pouring additional liquid into the funnel such that the additional liquid exits the nozzle, creating additional voids in the earth as the liquid exits the nozzle; and permitting the anchor device to drop into the additional voids.

15. The method of claim 14, wherein pouring additional liquid is ceased when a marking on the anchor device is at least level with the earth.

16. The method of claim 12, wherein the anchor device includes an elongate tube between the first member and nozzle.

17. The method of claim 12, further comprising inserting a beach umbrella into the first member.

18. The method of claim 12, wherein the nozzle has an opening with a diameter of between 0.4 inches and 1 inch.

19. The method of claim 12, wherein the nozzle comprises a first tubular section and a second tubular section connected by a tapered section.

20. The method of claim 4, wherein pouring includes pouring and forcing.

* * * * *